US008911150B2

(12) United States Patent
Gustavsson

(10) Patent No.: US 8,911,150 B2
(45) Date of Patent: Dec. 16, 2014

(54) VALVE

(75) Inventor: Martin Gustavsson, Göteborg (SE)

(73) Assignee: Micvac AB, Molndal (SE)

( * ) Notice: Subject to any disclaimer, the term of this patent is extended or adjusted under 35 U.S.C. 154(b) by 1448 days.

(21) Appl. No.: 10/558,029

(22) PCT Filed: May 21, 2004

(86) PCT No.: PCT/SE2004/000785

§ 371 (c)(1),
(2), (4) Date: Nov. 29, 2006

(87) PCT Pub. No.: WO2004/106190

PCT Pub. Date: Dec. 9, 2004

(65) Prior Publication Data

US 2007/0090109 A1 Apr. 26, 2007

(30) Foreign Application Priority Data

May 30, 2003 (SE) ..... 0301571

(51) Int. Cl.

| | |
|---|---|
| ***B65D 33/01*** | (2006.01) |
| ***B65D 51/16*** | (2006.01) |
| ***B65D 77/22*** | (2006.01) |
| ***B65D 81/34*** | (2006.01) |

(52) U.S. Cl.

CPC ..... *B65D 77/225* (2013.01); *B65D 81/34* (2013.01); *B65D 2205/00* (2013.01)

USPC ..... 383/103; 383/45; 383/49; 220/203.16; 220/202

(58) Field of Classification Search

USPC ..... 383/103, 44, 45, 48, 49, 51, 52; 220/203.16, 203.11, 203.17, 203.18, 220/203.15, 203.19, 203.08, 203.01, 202, 220/203.29, 203.02

See application file for complete search history.

(56) References Cited

U.S. PATENT DOCUMENTS

| | | | | |
|---|---|---|---|---|
| 1,862,155 | A * | 6/1932 | Gross et al. | 123/195 R |
| 2,604,297 | A * | 7/1952 | Winstead | 137/223 |
| 2,821,338 | A * | 1/1958 | Metzger | 383/94 |
| 2,870,954 | A * | 1/1959 | Kulesza | 206/524.8 |

(Continued)

FOREIGN PATENT DOCUMENTS

| | | |
|---|---|---|
| EP | 0 218 419 | 4/1987 |
| EP | 0 288 862 | 11/1988 |

(Continued)

OTHER PUBLICATIONS

Russian Office Action and English Translation thereof, May 21, 2004.

(Continued)

*Primary Examiner* — Jes F Pascua
*Assistant Examiner* — Peter Helvey
(74) *Attorney, Agent, or Firm* — Harness, Dickey & Pierce, P.L.C.

(57) ABSTRACT

A one-way valve is disclosed, particularly for foodstuff packages, the valve designed to be mounted on a package and arranged to open in response to an excess pressure inside said package. The valve includes an aperture formed in the package material. On top of the aperture an adhesive layer is arranged. The adhesive layer is arranged in such a manner that the valve, upon opening, exhibits a pre-defined channel allowing passage-through.

19 Claims, 9 Drawing Sheets

(56) References Cited

U.S. PATENT DOCUMENTS

Figure 1:
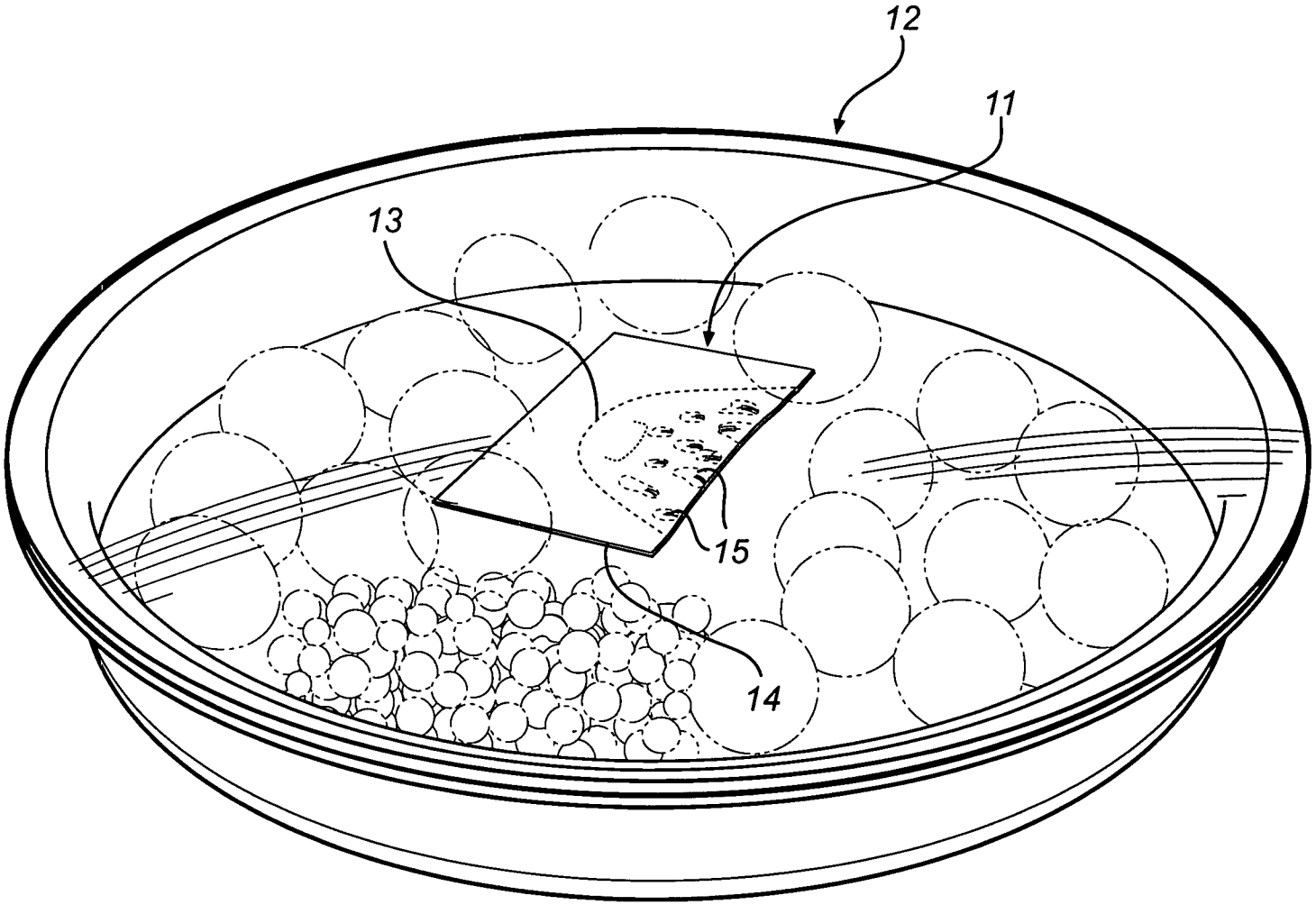
PRIOR ART Fig. 1

| | | | | | |
|---|---|---|---|---|---|
| 2,927,722 | A * | 3/1960 | Metzger | 383/94 |
| 2,946,502 | A * | 7/1960 | Metzger | 383/94 |
| 3,098,601 | A * | 7/1963 | Anderson et al. | 383/205 |
| 3,655,501 | A * | 4/1972 | Tesch | 428/136 |
| 3,989,182 | A * | 11/1976 | Stearley | 383/45 |
| 4,000,846 | A * | 1/1977 | Gilbert | 383/103 |
| 4,134,535 | A * | 1/1979 | Barthels et al. | 383/102 |
| 4,206,870 | A * | 6/1980 | DeVries | 383/103 |
| 4,461,420 | A * | 7/1984 | Horvath | 229/120 |
| 4,640,838 | A * | 2/1987 | Isakson et al. | 426/107 |
| 4,653,661 | A * | 3/1987 | Buchner et al. | 220/203.16 |
| 4,838,429 | A * | 6/1989 | Fabisiewicz et al. | 383/205 |
| 5,114,766 | A * | 5/1992 | Jacques | 428/35.7 |
| 5,263,777 | A * | 11/1993 | Domke | 383/103 |
| 5,326,176 | A * | 7/1994 | Domke | 383/103 |
| 5,482,492 | A * | 1/1996 | Becker | 446/224 |
| 5,553,942 | A * | 9/1996 | Domke et al. | 383/101 |
| 5,584,409 | A * | 12/1996 | Chemberlen | 220/89.1 |
| 5,595,521 | A * | 1/1997 | Becker | 446/224 |
| 5,727,881 | A * | 3/1998 | Domke | 383/103 |
| 5,947,287 | A * | 9/1999 | Weiss et al. | 206/439 |
| 5,989,608 | A * | 11/1999 | Mizuno | 426/113 |
| 6,089,271 | A * | 7/2000 | Tani | 137/854 |
| 6,250,049 | B1 * | 6/2001 | Feldman et al. | 53/452 |
| 6,663,284 | B2 * | 12/2003 | Buckingham et al. | 383/103 |
| 7,178,555 | B2 * | 2/2007 | Engel et al. | 137/852 |
| 7,243,683 | B2 * | 7/2007 | Stotkiewitz et al. | 137/859 |
| 7,244,223 | B2 * | 7/2007 | Hartman et al. | 493/213 |
| 7,294,354 | B2 * | 11/2007 | Gunter et al. | 426/118 |
| 7,331,715 | B2 * | 2/2008 | Miller et al. | 383/103 |
| 7,399,263 | B2 * | 7/2008 | Hartman et al. | 493/213 |
| 7,490,623 | B2 * | 2/2009 | Rypstra | 137/246 |
| 7,527,840 | B2 * | 5/2009 | Zeik | 428/35.2 |
| 7,596,931 | B2 * | 10/2009 | Gunter et al. | 53/471 |
| 2003/0035597 | A1 * | 2/2003 | Buckingham et al. | 383/103 |
| 2003/0123758 | A1 * | 7/2003 | Mita et al. | 383/38 |
| 2003/0183631 | A1 * | 10/2003 | Cross et al. | 220/203.17 |
| 2004/0223667 | A1 * | 11/2004 | Shah et al. | 383/103 |
| 2006/0050999 | A1 * | 3/2006 | Blythe et al. | 383/63 |
| 2007/0172157 | A1 * | 7/2007 | Buchman | 383/63 |
| 2007/0292055 | A1 * | 12/2007 | Reuhs et al. | 383/103 |
| 2009/0257685 | A1 * | 10/2009 | Matias | 383/38 |

FOREIGN PATENT DOCUMENTS

| | | | |
|---|---|---|---|
| EP | 1 157 942 | A1 | 11/2001 |
| FR | 2 796 924 | | 2/2001 |
| RU | 2 096 982 | | 11/1997 |
| WO | WO 02/087993 | A1 | 11/2002 |
| WO | WO 2004/048225 | A1 | 6/2004 |

OTHER PUBLICATIONS

Internatinoal Search Reports, Aug. 23, 2005.

* cited by examiner

VALVE

TECHNICAL FIELD OF THE INVENTION

The present invention relates to a one-way valve designed to be mounted on a package and arranged to open in response to an excess pressure inside said package, said valve comprising an aperture formed in the package material, on top of which aperture an adhesive layer is arranged.

TECHNICAL BACKGROUND

A one-way valve of the kind outlined above is already known from patent application Ser. No. WO 02/087993. A valve of the kind referred to is used in particular in conjunction with cooking and packaging of ready-to-eat dishes, in a manner ensuring that the valve functions both when the food is being cooked and when it is finally heated preparatory to consumption. When the heating process in conjunction with the cooking of the food is stopped, the valve should close, and this could be achieved for example purely mechanically by means outside the package, pressing said layer against the package material. Alternatively, valve closing could be achieved by choosing an adhesive layer of a kind that resumes its position on top of the aperture in the package material automatically and in doing so closes the valve. On account of the considerable flow of hot vapour through the valve bubbles may form between the adhesive layer and the package material in the areas where said adhesive layer has separated from the package material (see FIG. 1) when the valve closes following the initial heating in conjunction with the packaging of the food. In some cases, a series of bubbles may form in this manner, and these bubbles may form a channel running from the aperture formed in the package material and up to one of the edges of the adhesive layer.

SUMMARY OF THE INVENTION

The object of the present invention therefore is to provide a one-way valve designed to solve the problem outlined above.

This object is achieved in accordance with the invention by means of a one-way valve possessing the characteristics defined in the appended claim 1. Preferred embodiments of the one-way valve are defined in the dependent claims.

By the expression "adhesive layer" as used herein should be understood a front/cover material coated with an adhesive.

The inventive one-way valve comprises an aperture formed in the package material and above which an adhesive layer is provided. The adhesive layer is arranged in such a manner that the valve, when opening, exhibits a pre-defined channel allowing passage-through. The advantage of a valve of this kind thus is that it opens in a more controlled manner in that it becomes possible to determine in advance the valve opening direction. A consequence of the feasibility to control the valve opening direction is that it becomes possible to produce a valve the channel length of which is sufficient to ensure that any bubbles that may generate underneath the adhesive layer as the valve closes do not form a chain running all the way from the aperture in the package material up to the edge of the adhesive layer.

The valve preferably is formed with two short sides and two long sides, i.e. it has an essentially rectangular shape. Owing to this configuration the manufacturing costs may be comparatively low, since it allows the valves to be manufactured in a manner identical to that of a long strip of labels.

In accordance with one preferred embodiment of the present invention a first adhesive is applied on one face of the adhesive layer along the long sides of the latter while a second adhesive, the adhesive force of which is less strong than that of the first adhesive, is applied between those two parts along the long sides of the adhesive layer on which said first adhesive is applied. Consequently, vapour from inside the package may escape at the short sides of the adhesive layer.

In accordance with one variety of the embodiment described above a first adhesive is applied on the entire surface of one face of the adhesive layer and a second adhesive, the adhesive force of which is less strong than that of the first adhesive, is applied on top of said first adhesive at a distance from the long sides of the adhesive layer. In this manner, the same function is obtained as in accordance with the embodiment described above.

In accordance with yet another embodiment only one of the short sides is arranged to open, i.e. the opposite short end is provided with the same adhesive as that applied along the long sides. This arrangement makes it possible for a channel to form, the length of which exceeds half the length of the adhesive layer, with consequential less risk that rows of touching bubbles form a channel extending all the way from the aperture in the package material to the openable short side.

In accordance with another preferred embodiment the adhesive layer is formed with an aperture the edges of which surrounds said aperture formed in the package material while yet a further adhesive layer is arranged on top of the first adhesive layer and the two adhesive layers are joined together along their long sides. One of the advantages of this kind of valve is that it makes it possible to use an identical adhesive over the entire surface (of one face) of the adhesive layers, when the long sides are joined together, for instance by means of welding. Also this embodiment makes it possible to ensure that valve opening may occur only at one of the short sides in that the short sides are joined together and then preferably in the same way as the long sides.

According to one variety of the above-described embodiment, the aperture formed in the package material consists of a plurality of parallel cuts and the aperture formed in the adhesive layer positioned closest to the package of a plurality of parallel cuts, said adhesive layer being applied on the package in such a manner that the parallel cuts in the adhesive layer extend at an angle relative to the parallel cuts formed in the package material. One advantage offered by this type of valve is that it reduces the risk that the adhesive in the upper adhesive layer will come into contact with the contents inside the package, which in turn increases the freedom of choice of adhesive to be used. From a purely handling point of view this valve offers a further advantage, when it is provided in a prefabrication step with a protective film. When the aperture in the adhesive layer closest to the package is a hole, this hole preferably is produced by punching with the protected film applied. As a result, when the valve is to be applied on a package, the protective film in the area of this hole, together with the part of the adhesive layer that is removed to form the hole, must be stripped off in a separate step. In a valve in accordance with the arrangement mentioned above comprising a plurality of cuts in one of the adhesive layers, the cuts are made in the adhesive layer only and there is no need for any manipulation of the protective layer. Accordingly, several valves may be manufactured in succession on a strip, which in turn may for example be wound into a roll of valves.

In accordance with yet another embodiment of the present invention a pattern may be printed on the package material, alternatively on the adhesive layer closest to the package material on the face that is turned away from the package. The advantage of providing some kind of print lies in the possibility it offers of lessening the adhesive force. In some embodiments in accordance with the present invention, exhibiting a longer distance from the aperture formed in the package material to the edge of the adhesive layer, i.e. the length of the ventilation channel, the force or the excess pressure required to open the valve preferably should not be too strong. If it is, there is a risk, in cases when the package consists for example of a tray covered by plastic foil, that the foil separates from the tray before the valve opens. By printing a pattern as indicated above using for example conventional printer's ink or silicone, a method commonly referred to as "release coating", the adhesive force may be adjusted to a degree sufficient to avoid that the plastic foil separates from the tray in response to an excess pressure inside the package. In most adhesives the bonding force is at its peak some time after their application and depending on the nature of the adhesive this is a question of seconds, minutes, hours or days. The adhesives most suitable for use in conjunction with the invention are those reaching their bonding peak after a couple of days. In cases when the package is not intended to be subjected to the final heating within a couple of days, calculated from the instance of packaging, alternatively in cases when the valve is prefabricated and is not applied on the package within a couple of days, the adhesive force of the adhesive has reached its maximum. For this reason it is suitable to print a pattern on the intended area of application of the adhesive layer in order to reduce the maximum adhesive force of the adhesive layer.

BRIEF DESCRIPTION OF THE DRAWING FIGURES

The invention will be described in the following by means of some embodiments thereof with reference to the accompanying drawings, wherein:

FIG. 1 shows a valve in accordance with the prior art as applied on a package.

Figure 2A:
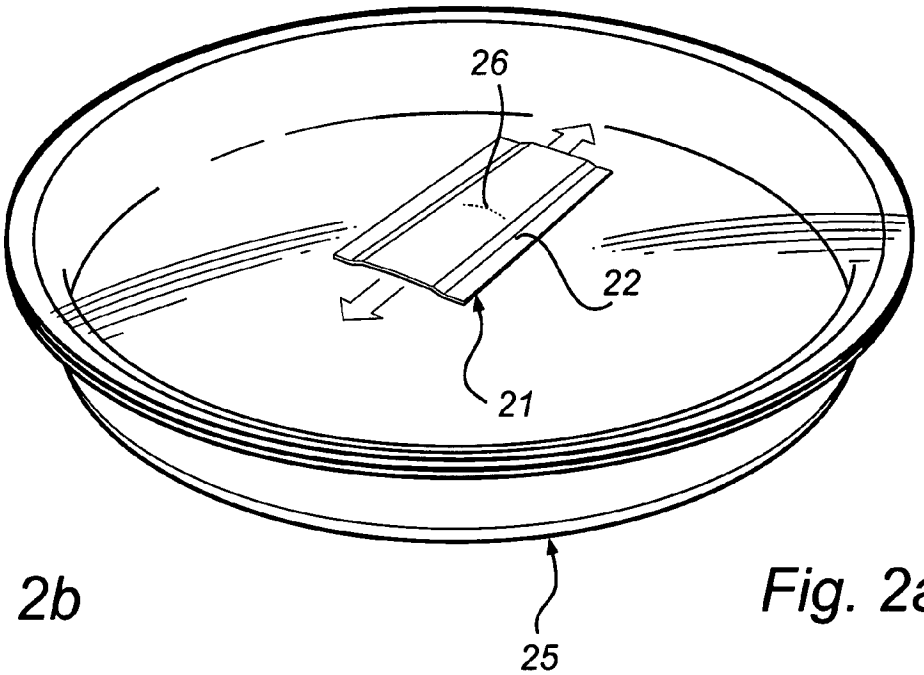
Figure 2B:
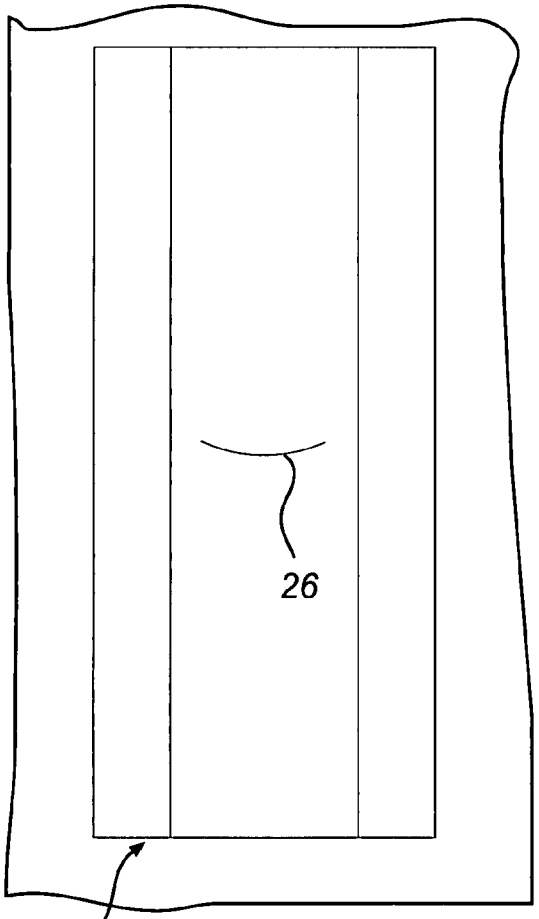
Figure 2C:
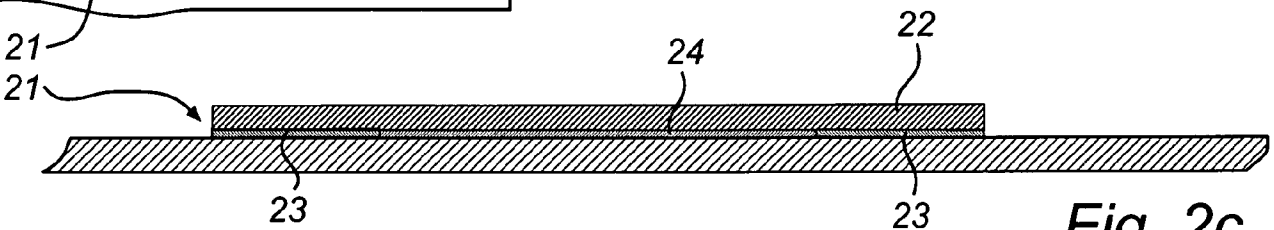

FIGS. 2*a*-2*c* show a first embodiment of a valve in accordance with the present invention.

Figure 3A:
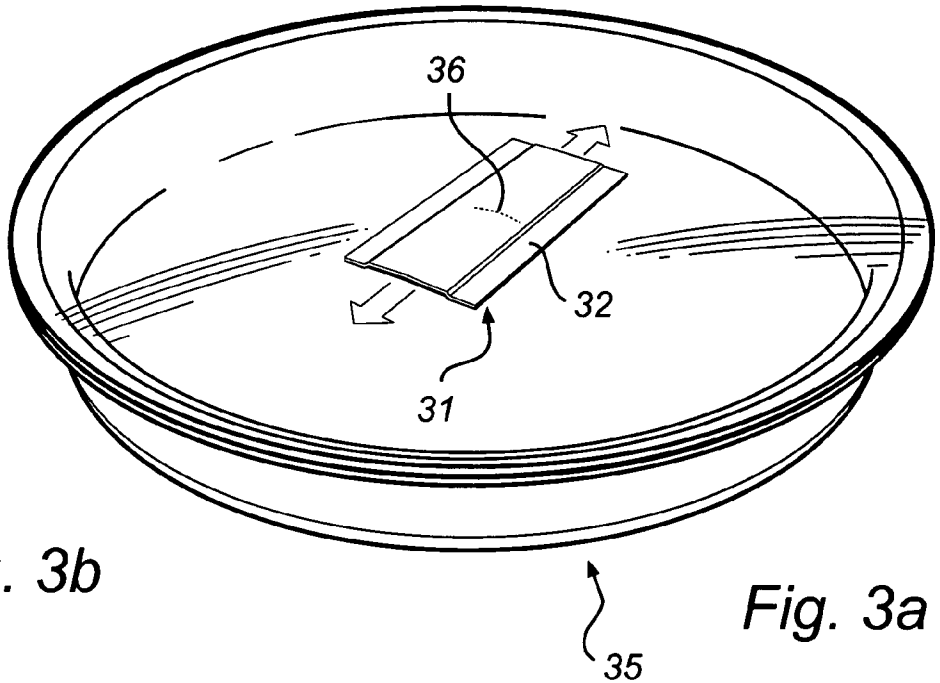
Figure 3B:
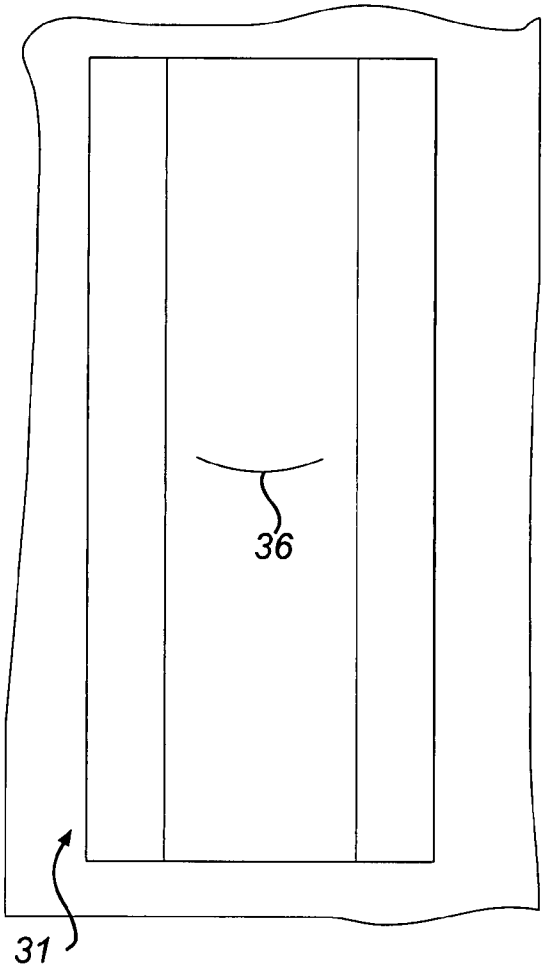
Figure 3C:
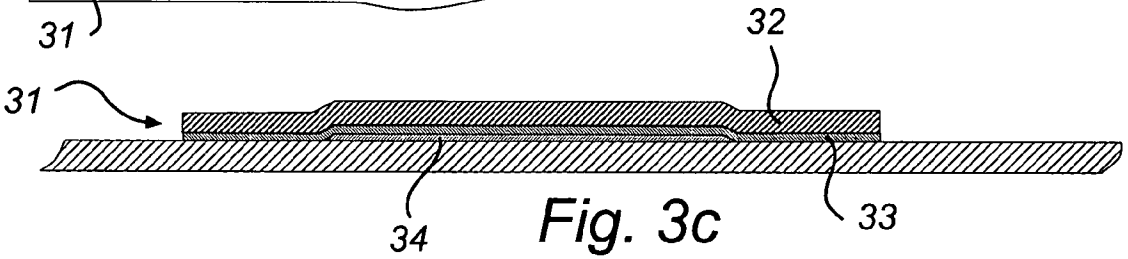
Figure 4A:
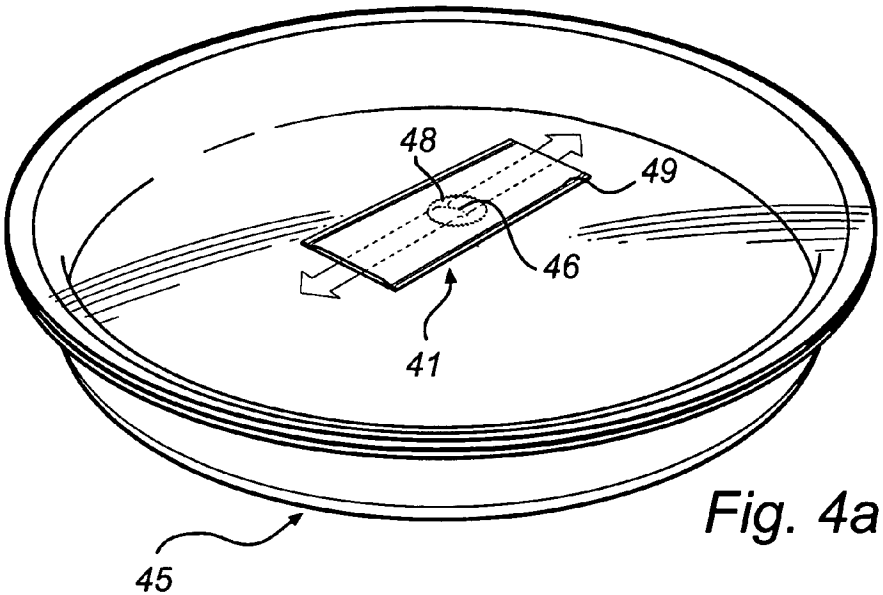
Figure 4B:
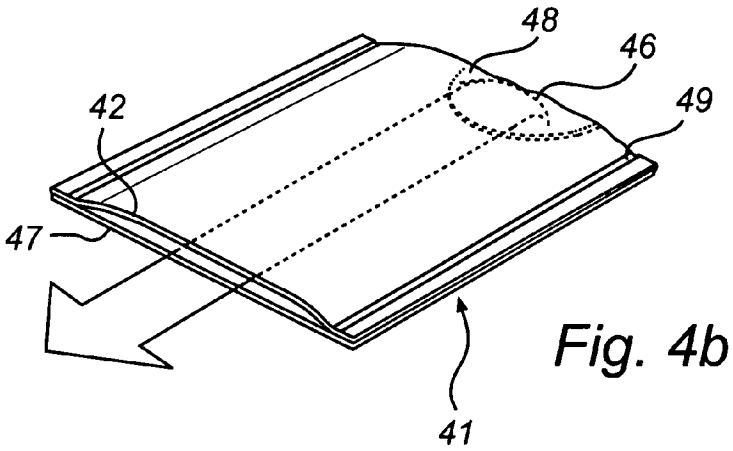
Figure 4C:
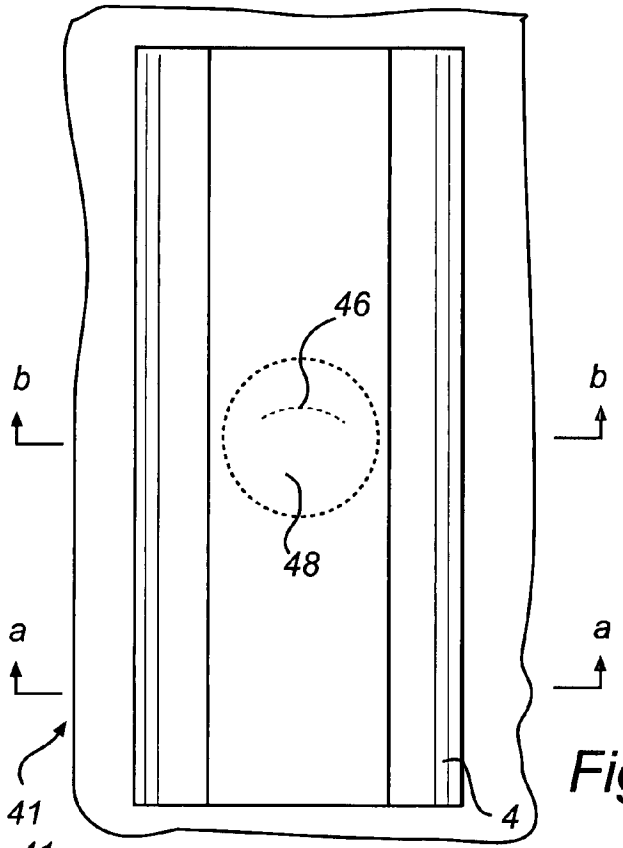
Figure 4D:
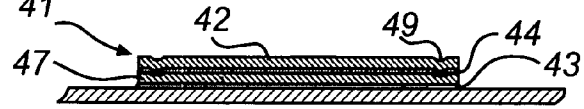
Figure 4E:
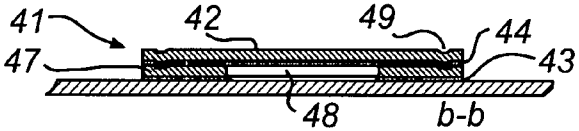

FIGS. 3*a*-3*c* show a second embodiment of a valve in accordance with the present invention.

FIGS. 4*a*-4*e* show a third embodiment of a valve in accordance with the present invention.

Figure 5A:
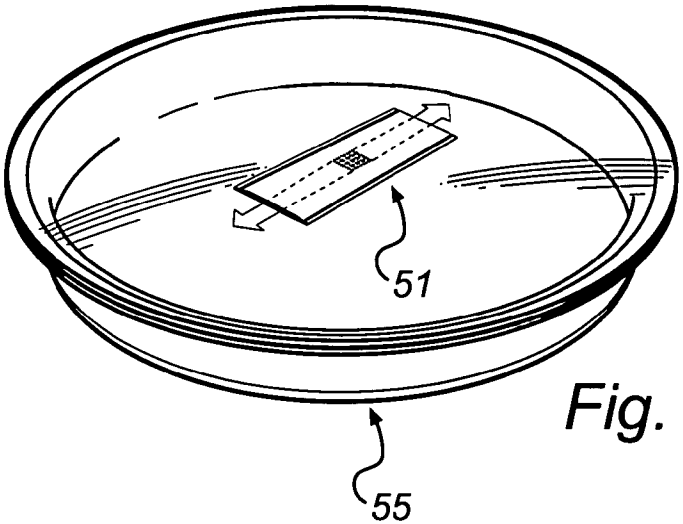
Figure 5B:
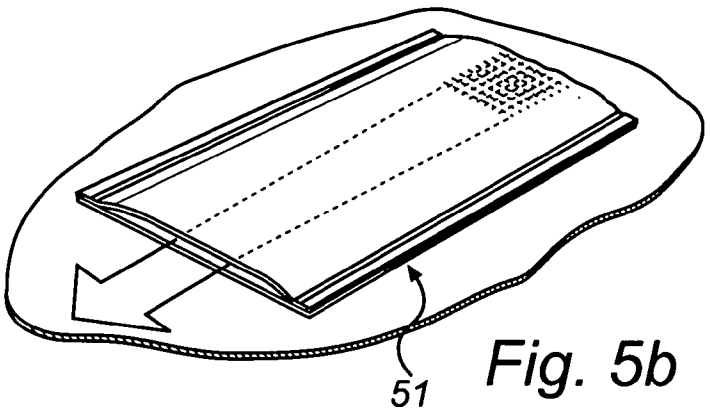
Figure 5C:
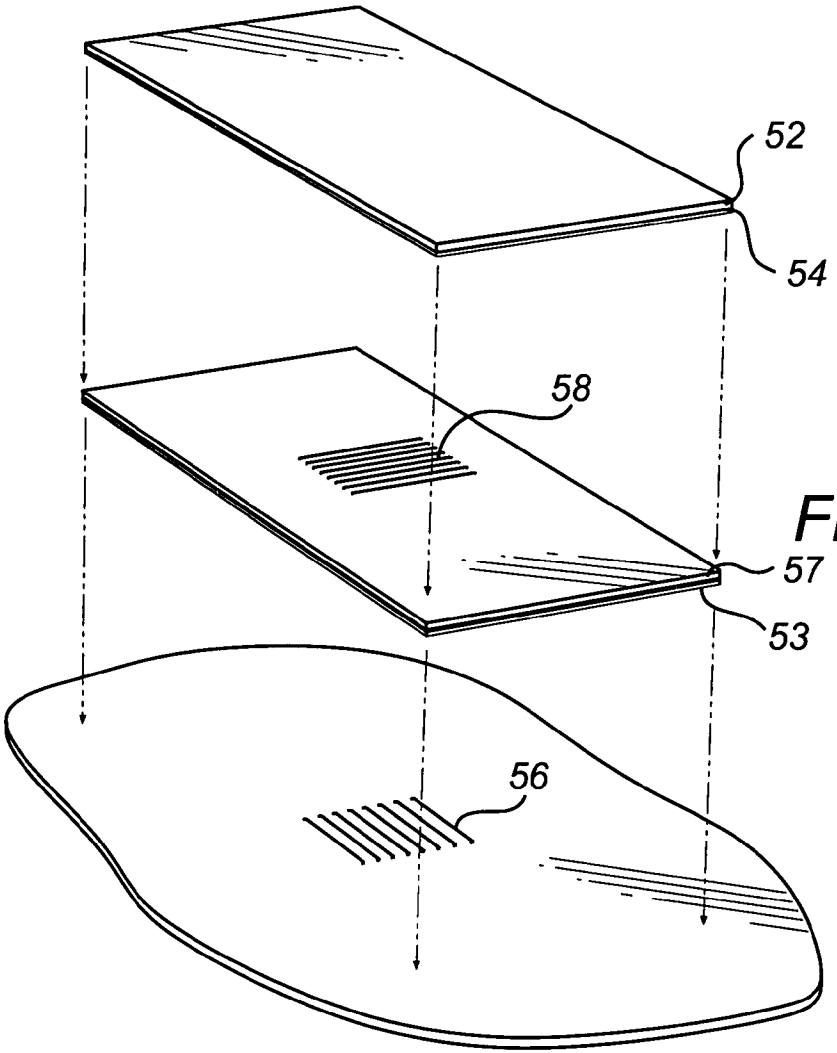
Figure 6A:
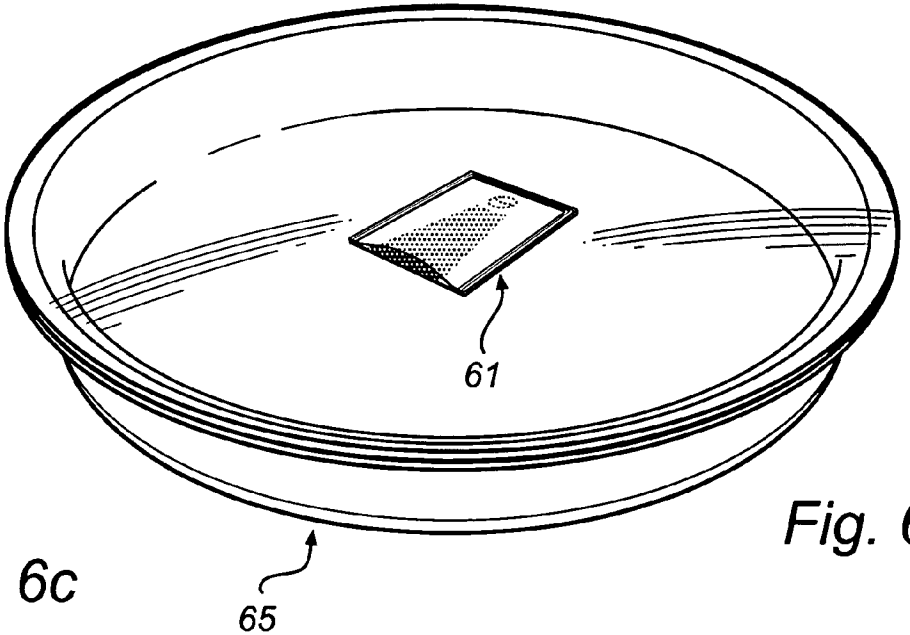
Figure 6B:
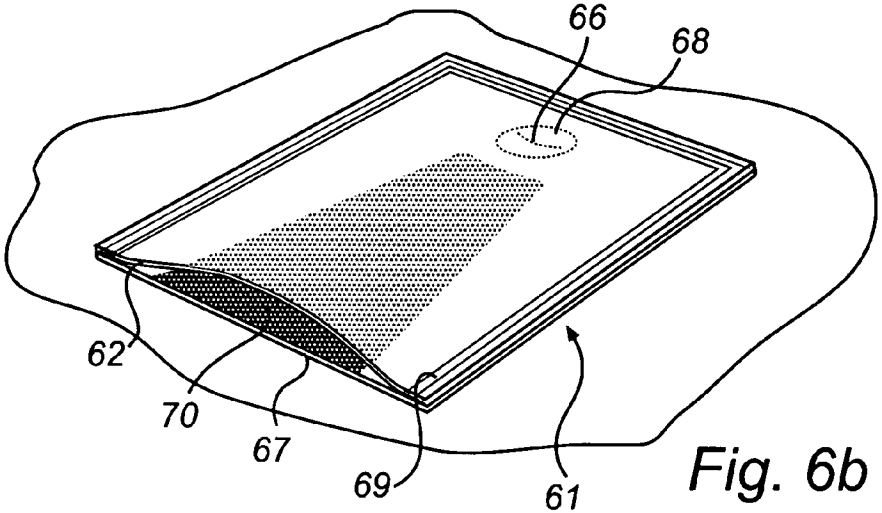
Figure 6C:
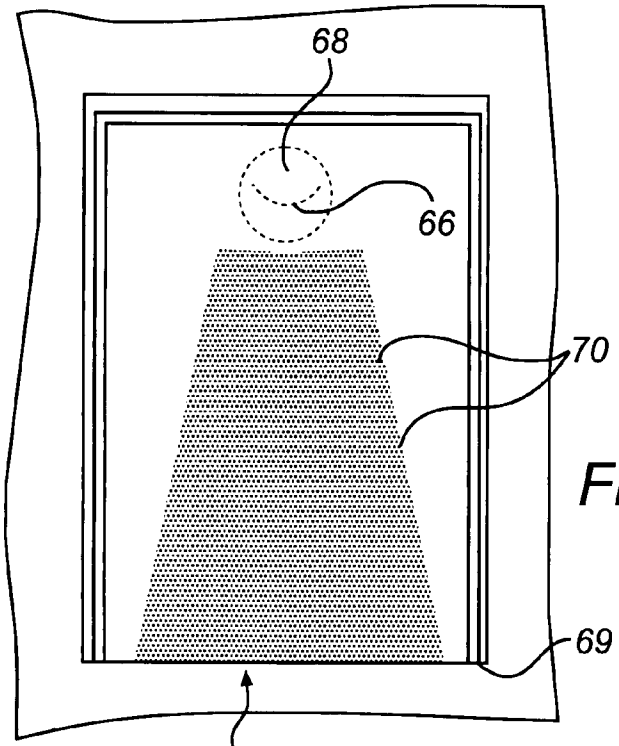
Figure 6D:
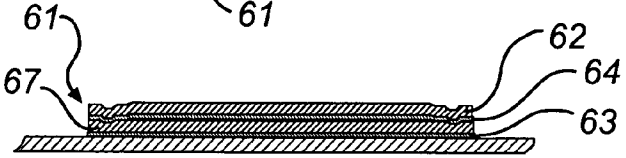
Figure 7A:
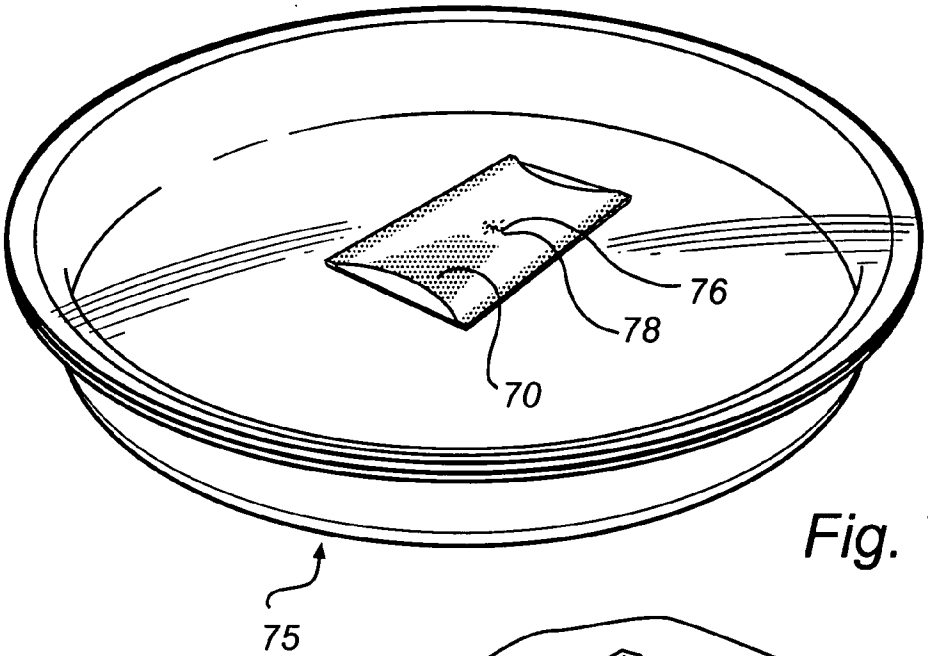
Figure 7B:
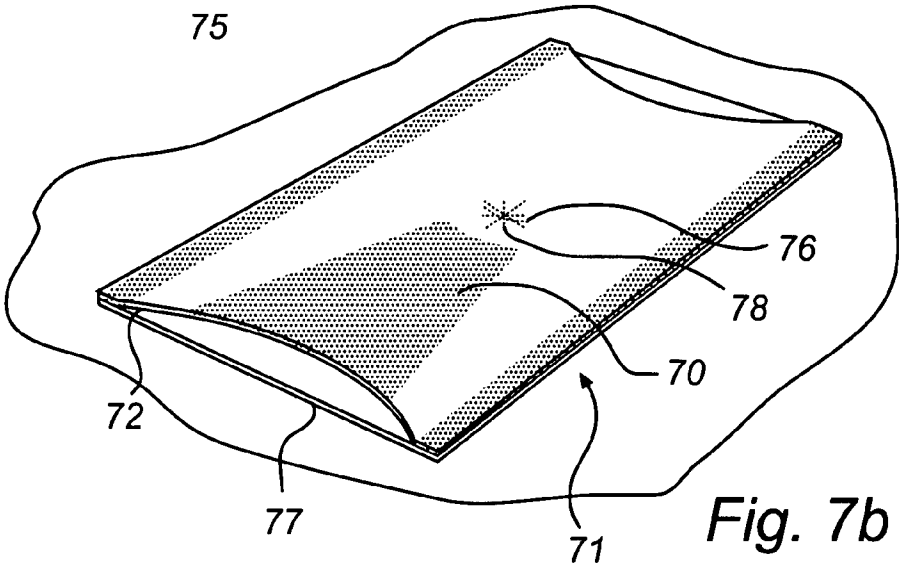
Figure 7C:
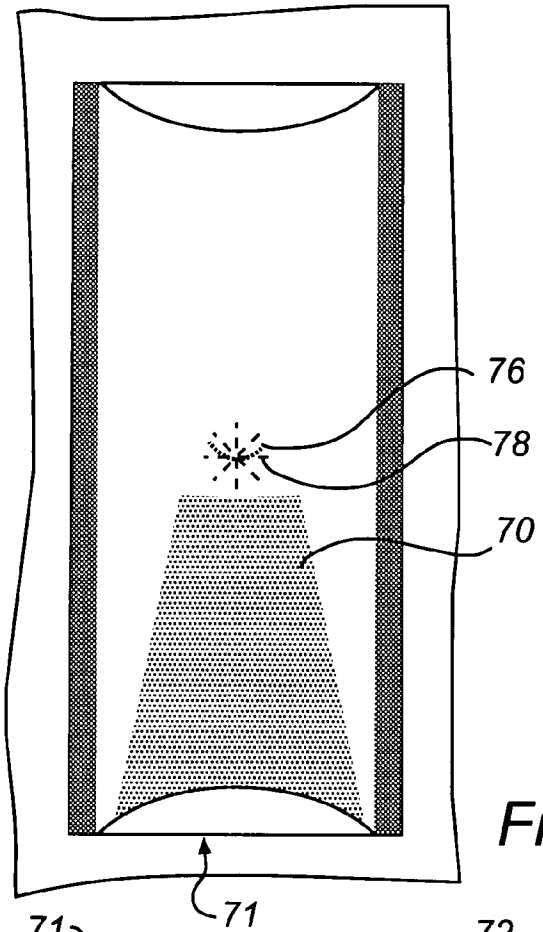
Figure 7D:
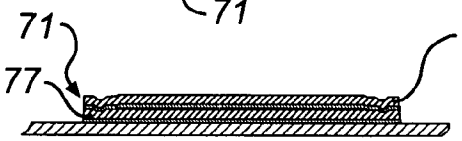

FIGS. 5*a*-5*c* show a fourth embodiment of a valve in accordance with the present invention.

FIGS. 6*a*-6*d* show a fifth embodiment of a valve in accordance with the present invention.

FIGS. 7*a*-7*d* show a sixth embodiment of a valve in accordance with the present invention.

Figure 8A:
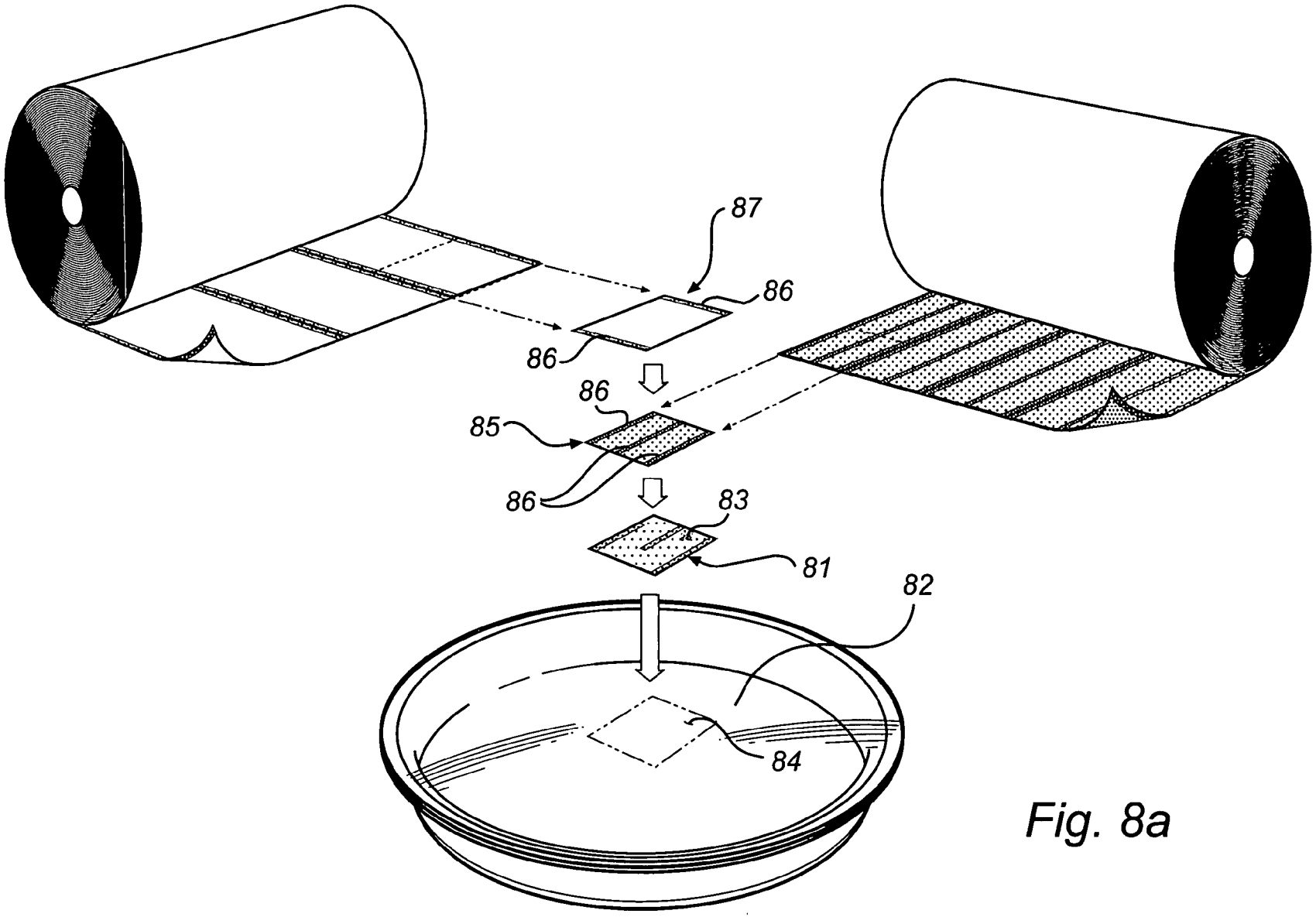
Figure 8B:
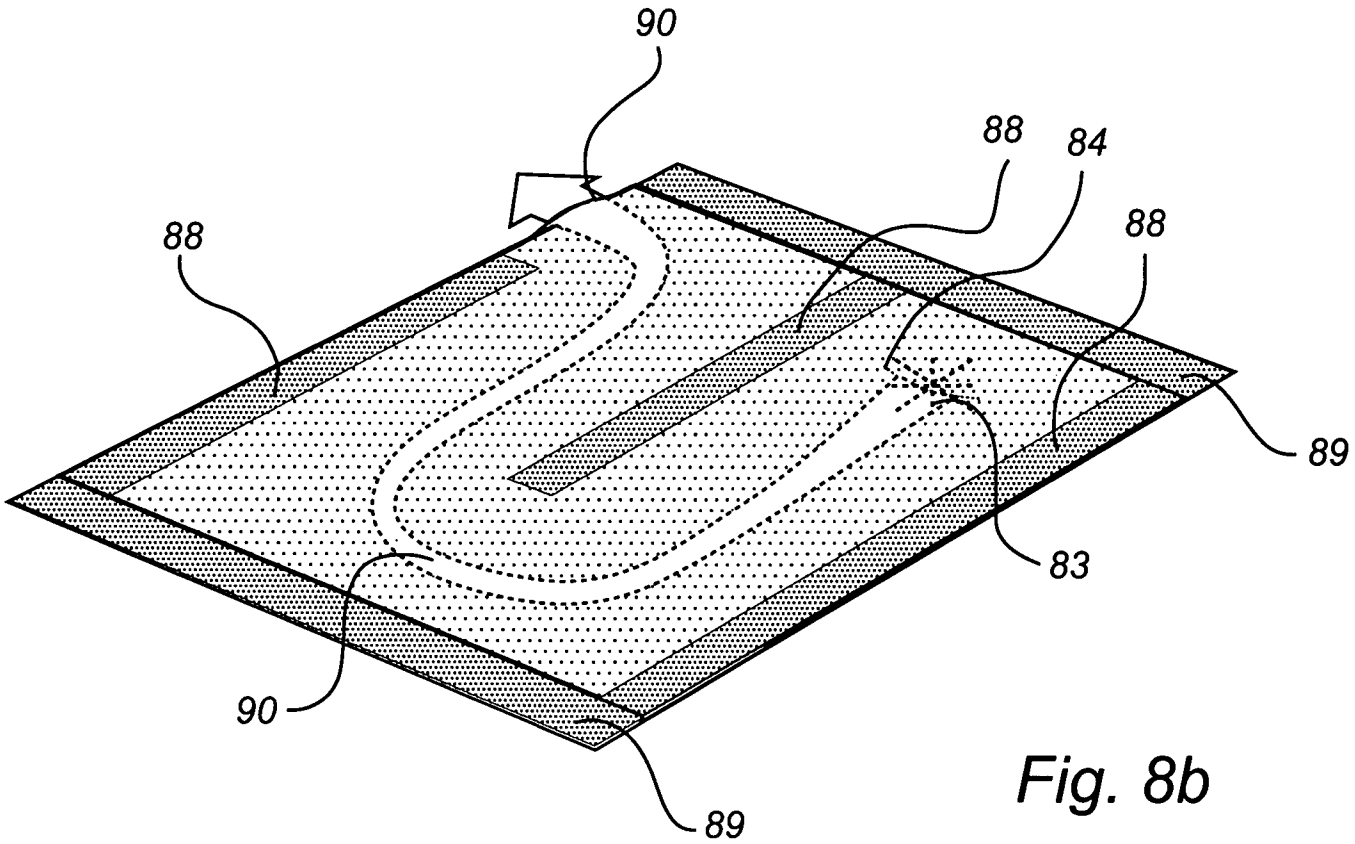

FIGS. 8A and 8B show a seventh embodiment of a valve in accordance with the present invention.

DETAILED DESCRIPTION OF PREFERRED EMBODIMENTS

FIG. 1 shows a valve 11 applied on a package 12 in accordance with the prior art. The dotted line 13 illustrates the border line between the part of the adhesive layer 14 that separates from the package 12 and the part of the adhesive layer 14 that still sticks to the package when the valve 11 opens. Following opening of the valve 11 and its automatic closing, bubbles 15 may generate, as illustrated, within the arcuate shape defined by the dotted line 13.

FIGS. 2*a*-2*c* illustrate an embodiment of a valve 21 in accordance with the present invention. Along the long sides of the adhesive layer 22 a first adhesive 23 is applied and intermediate these adhesive-coated areas a second adhesive 24 is applied. Upon generation of an excess pressure inside the package 25, vapour tries to escape through the aperture 26 (which in this case consists of an arcuate cut) formed in the package 25. By suitable choice of the adhesives 23, 24 to ensure that the adhesive 23 extending along the long sides will possess the stronger adhesive force, flow-through passages or channels form, leading up to the short sides of the adhesive layer 22 from the aperture 26 in the package 25, as the excess pressure inside the package 25 rises to a level above a minimum opening value. Upon cease of heating of the package contents, pressure equalisation occurs, and the valve 21 closes as a result of the adhesive layer 22, on account of its resiliency, resuming its original position in contact with the package 25.

FIGS. 3*a*-3*c* show an alternative embodiment of a valve 31 in accordance with the present invention, which is distinguished from the embodiment of FIGS. 2*a* and 2*b* in the manner of application of the various adhesives on the adhesive layer 32. Adhesive 33, possessing the stronger adhesive force, is applied over the entire surface of one face of the adhesive layer 32 whereas the second adhesive 34 is applied on the adhesive layer 32, except along the long sides of the adhesive layer 32. Owing to this arrangement, valve 31 operates in the same manner as valve 21 in FIGS. 2*a*-2*c*.

FIGS. 4*a*-4*e* show a further embodiment of a valve 41 in accordance with the present invention. Like in accordance with the embodiments in drawing FIGS. 2 and 3, an adhesive layer 42 is arranged in a manner ensuring that channels may form. The difference in this case is that a second adhesive layer 47 is interposed between the package 45 and the first adhesive layer 42. Preferably, the adhesive 43 of the second adhesive layer 47 possesses an adhesive force exceeding that of the adhesive 44 of the first adhesive layer 42. A hole 48 is punched in the second adhesive layer 47 in such a manner that it encloses the aperture 46 formed in the package 45. Instead of employing only one adhesive layer 22, 32, like in the two preceding embodiments, wherein two different adhesives 23, 24, 33, 34 are used in order to ensure the formation of a passage or channel when the valve opens, the two adhesive layers 42, 47 are in this case joined together along their long sides by means of a weld seam 49. When the excess pressure inside the package 45 rises above a certain value, a channel consequently forms between the two adhesive layers 42, 47.

FIGS. 5*a*-5*d* illustrate an additional embodiment of a valve 51 in accordance with the present invention. The difference from the embodiment of FIG. 4 is that the hole 48 has been replaced by a plurality of parallel cuts 58. Also the aperture 56 formed in the package 55 consists of a plurality of parallel cuts, the cuts in the package extending at an angle to the cuts formed in the adhesive layer 57. When the valve 51 opens several small apertures form in the crossover points between the cuts 58 in the adhesive layer 57 and the cuts 56 in the package. When the valve 51 closes, these apertures shut and thus the contents inside the package will never come into contact with the adhesive 54 applied on the first adhesive layer 52.

FIGS. 6*a*-6*d* show an alternative embodiment of a valve 61 in accordance with the present invention. A pattern 70 (known as a "release coating") is printed on the second adhesive layer 67 by means of printer's ink or silicone in order to facilitate the opening of the valve 61. In addition, one of the short sides of each one of the two adhesive layers 62, 67 also have been welded together in order to thus form a longer channel without prolonging the adhesive layers 62, 67.

Yet another alternative embodiment of a valve 71 is shown in FIGS. 7*a*-7*d*. According to this embodiment the outer adhesive layer 72 has been shortened/cut at its short sides for the purpose of reducing the risk of formation of "bubbles" after the valve has been open. Under some circumstances, the outer adhesive layer may deform plastically on account of the heat, and shortening/cutting the short sides reduces the effect of such potential deformation. Furthermore, the cut 76 formed in the package material 75 preferably is arcuate and the aperture 78 formed in the adhesive layer 77 closest to the package material 75 preferably consists of a plurality of straight cuts placed crosswise. In accordance with this embodiment, the "release coating" is applied only between the aperture 78 in the adhesive layer 77 closest to the package material 75 and one of the short sides. When the valve assumes its open position over a longer period, for example during the cooking of the food, the valve opens more and more towards the short side devoid of "release coating", and for this reason it is suitable that the aperture is spaced equally from both short sides in order to prevent the valve from opening at both short sides, i.e. that the distance between the aperture 78 and the short side devoid of "release coating" is sufficiently long. This valve designed without a weld at one of the short sides is easier to produce manufacture—wise than the valve in FIG. 6 and the production thereof therefore cheaper.

Should nonetheless a long vapour passage be desired in the valve having welds or being provided with an adhesive possessing a high adhesive force applied in one direction only on an adhesive layer, an arrangement of this kind could be achieved for example as shown in FIGS. 8*a* and 8*b*. A first adhesive layer 81, provided with an aperture 83, is applied closest to the package material 82, and said adhesive layer 81 is arranged in such a manner that its aperture 83 will be located on top of an aperture 84 formed in the package material 83. A second adhesive layer 85 is arranged on top of said first adhesive layer 81 and this second layer 85 is adhesive-free along three parallel lines 86. Adhesive-free areas of the adhesive layer often are easier to weld than areas provided with an adhesive. A third adhesive layer 87 is applied on top of the two first adhesive layers 81, 85, and also this third adhesive layer is formed with adhesive-free lines 86. The third adhesive layer 87 is placed at an angle of ninety degrees relative to the second adhesive layer 85, and the short sides of the second adhesive layer 85 are sealed by welding together the third adhesive layer 87 with the first adhesive layer 81 and to some extent also with the second adhesive layer 85. The second adhesive layer 85 is joined to the first adhesive layer 81 by welding in the areas marked by numeral 88 in FIG. 8*b*, and the third adhesive layer 87 is joined to the first adhesive layer 81 by means of welding along the areas indicated by numeral 89 in FIG. 8*b*. The second adhesive layer 85 thus is somewhat smaller than the other adhesive layers 81, 87. When the valve is open, vapour will flow between the first adhesive layer 81 and the second adhesive layer 85. In the valve according to this embodiment, a U-shaped vapour passage 90 is formed.

It will be appreciated that numerous modifications of the embodiments described above are possible within the scope of protection as defined in the appended claims. As described above, it is for instance possible to use two different adhesives for the outer adhesive layers 42, 52, 62, 72 instead of welding them together. In addition, the printed pattern may be effected by other means than printer's ink and silicone, provided the substitute reduces the adhesive force of the adhesive. The use of silicone makes it possible to make the valve practically transparent. An alternative to the printed pattern on the support is to print it instead on the adhesive layer. Owing to the formation of channels or passageways in the valve as defined above also control of the width of the vapour outlet is achieved, i.e. the width of the valve less the area of the adhesive layer having the stronger adhesive, alternatively the joined-together areas of the valve. Under some circumstances, the valve emits a sound signal owing to oscillation of the short side/short sides of the adhesive layer. The frequency of this sound signal may thus be controlled by varying the width of the short side. In addition, the shape of the cuts in the package may be varied. The cuts shown herein have an arcuate or straight configuration but they could also have a zigzag or wavy configuration. In addition, the above description of the invention is essentially directed to a valve formed with short sides and long sides, in order to facilitate the understanding of the description. However, the adhesive layer could have a different shape from the rectangular one, i.e. shapes without short and long sides, such as for example circular or star-shaped valves.

The invention claimed is:

1. A valve designed to be mounted on a package having an aperture and arranged to open in response to an excess pressure inside said package, said valve comprising:

a first adhesive layer arranged in use to cover said aperture in the package, the first adhesive layer being formed with an aperture corresponding with the aperture of the package; and an additional resilient adhesive layer arranged on top of the first adhesive layer, the first and additional resilient adhesive layers being joined together in such a manner that the valve upon opening, exhibits a pre-defined channel allowing passage-through between the first and additional resilient adhesive layers, wherein the first and additional resilient adhesive layers are joined together by a weld seam, forming a depression, along long sides of the valve, and in the area excluding the weld seam, only a single-type adhesive of said additional resilient adhesive layer is present on an entire inner surface of thereof including an area corresponding to the pre-defined channel formed between the first and additional resilient adhesive layers.

2. The valve as claimed in claim 1, wherein said valve has a shape including two long sides and two short sides.

3. The valve as claimed in claim 2, wherein said first and additional resilient adhesive layers are joined together along their long sides.

4. The valve as claimed in claim 3, wherein the first and additional resilient adhesive layers are also joined together at one of the short sides.

5. The valve as claimed in claim 1, wherein the aperture of the package is a cut.

6. The valve as claimed in claim 5, wherein the aperture of the first adhesive layer includes a plurality of cuts.

7. The valve as claimed in claim 1, wherein the aperture of the first adhesive layer closest to the package includes a plurality of cuts arranged in parallel relationship and wherein the aperture of the package includes several parallel cuts, said first adhesive layer being arranged on the package in a manner ensuring that the parallel cuts in the adhesive layer extend at an angle relative to parallel cuts formed in the package material.

8. The valve as claimed in claim 1, wherein a pattern is printed on the first adhesive layer closest to the package, at least on at least one of a part and area of said first adhesive layer that is covered by the additional resilient adhesive layer.

9. The valve as claimed in claim 8, wherein said print is formed by ink.

10. The valve as claimed in claim 8, wherein said print is silicone.

11. The valve as claimed in claim 1, wherein said package is a foodstuff package.

12. The valve as claimed in claim 1, wherein the valve is an one-way valve.

13. The valve as claimed in claim 1, further comprising an additional adhesive on the first adhesive layer located between the first adhesive layer and the package.

14. The valve as claimed in claim 13, wherein the additional adhesive of the first adhesive layer possesses an adhesive force exceeding the adhesive of the additional resilient adhesive layer.

15. A package including the valve of claim 1.

16. The valve as claimed in claim 1, wherein the weld seam is located inwardly from an edge of the long side ends of the valve.

17. A package for processing foodstuff, comprising:

a tray having an opening configured to hold foodstuff therein;

a film configured to enclose the opening of the tray, the film includes an aperture; and a valve designed to be mounted over the aperture of the film and arranged to open in response to an excess pressure inside said package, said valve includes:

a first adhesive layer arranged in use to cover said aperture in the package, the first adhesive layer being formed with an aperture corresponding with the aperture of the package; and an additional resilient adhesive layer arranged on top of the first adhesive layer, the first and additional resilient adhesive layers being joined together in such a manner that the valve upon opening, exhibits a predefined channel allowing passage-through between the first and additional resilient adhesive layers, wherein the first and additional resilient adhesive layers are joined together by a weld seam, forming a depression, along long sides of the valve, and in the area excluding the weld seam, only a single-type adhesive of said additional resilient adhesive layer is present on an entire inner surface of thereof including an area corresponding to the pre-defined channel formed between the first and additional resilient adhesive layers.

18. The valve as claimed in claim 1, wherein portions of the adhesive layers where the weld seam is present is not provided with adhesive.

19. The package as claimed in claim 17, wherein portions of the adhesive layers where the weld seam is present is not provided with adhesive.

* * * * *